US008088983B2

(12) United States Patent
Nakamura

(10) Patent No.: US 8,088,983 B2
(45) Date of Patent: Jan. 3, 2012

(54) FALLBOARD OPENING AND CLOSING DEVICE

(75) Inventor: Makoto Nakamura, Musashino (JP)

(73) Assignee: Casio Computer Co., Ltd, Tokyo (JP)

( * ) Notice: Subject to any disclaimer, the term of this patent is extended or adjusted under 35 U.S.C. 154(b) by 0 days.

(21) Appl. No.: 12/794,133

(22) Filed: Jun. 4, 2010

(65) Prior Publication Data

US 2010/0326253 A1 Dec. 30, 2010

(30) Foreign Application Priority Data

Jun. 30, 2009 (JP) ..... 2009-154673

(51) Int. Cl.
*G10C 3/02* (2006.01)

(52) U.S. Cl. ..... 84/179; 84/423 R

(58) Field of Classification Search ..... 84/179, 84/423 R

See application file for complete search history.

(56) References Cited

U.S. PATENT DOCUMENTS

| | | | | |
|---|---|---|---|---|
| 5,837,911 | A * | 11/1998 | Inoue | 84/179 |
| 6,686,521 | B2 * | 2/2004 | Sandifer | 84/179 |
| 2004/0182223 | A1 * | 9/2004 | Kuwahara et al. | 84/423 R |
| 2007/0157794 | A1 * | 7/2007 | Suzuki et al. | 84/423 R |

FOREIGN PATENT DOCUMENTS

| | | |
|---|---|---|
| JP | 04-072286 | 6/1992 |
| JP | 04-089997 | 8/1992 |
| JP | 11-161263 | 6/1999 |
| JP | 2000-250529 | 9/2000 |
| JP | 2003-263151 | 9/2003 |
| JP | 2004-020576 | 1/2004 |
| JP | 2004-302419 | 10/2004 |
| JP | 2005-107462 | 4/2005 |
| JP | 2005-211322 | 8/2005 |
| JP | 2007-154570 | 6/2007 |

OTHER PUBLICATIONS

Chinese Office Action for Chinese Patent Application Serial No. 201010218295.1 mailed on Jun. 24, 2011.

Japanese Office Action for Japanese Patent Application No. 2009-154673 mailed on Sep. 14, 2011.

* cited by examiner

*Primary Examiner* — Jianchun Qin

(74) *Attorney, Agent, or Firm* — Turocy & Watson, LLP

(57) ABSTRACT

An opening and closing device 10 for a fallboard 8 includes a first damper member 13 that dampens the rotational movement of the fallboard 8 by constantly applying a fixed load to the fallboard 8, and a second damper member 14 that dampens the rotational movement of the fallboard 8 by applying a load to the fallboard 8 depending on a closing movement or an opening movement of the fallboard 8. Accordingly, when the fallboard 8 is being closed, the closing movement of the fallboard 8 can be slowed by being dampened by the first damper member 13 and the second damper member 14, and when the fallboard 8 is being opened, the opening movement of the fallboard 8 can be slowed by being dampened by the first damper member 13 and the second damper member 14.

3 Claims, 11 Drawing Sheets

FALLBOARD OPENING AND CLOSING DEVICE

CROSS-REFERENCE TO RELATED APPLICATION

This application is based upon and claims the benefit of priority from the prior Japanese Patent Application No. 2009-154673, filed Jun. 30, 2009, the entire contents of which is incorporated herein by reference.

BACKGROUND OF THE INVENTION

1. Field of the Invention

The present invention relates to a fallboard opening and closing device used in a keyboard instrument, such as a piano or an organ.

2. Description of the Related Art

Conventionally, as described in Japanese Patent Application Laid-Open (Kokai) Publication No. 2003-263151, a keyboard instrument is known that has a structure in which a fallboard is attached to an instrument case by a hinge that allows it to open and close. In the configuration of this fallboard opening and closing device, a connecting shaft rotatably connects a pair of hinge pieces of the hinge. A first contacting section bent into a U-shape, which is in contact with one hinge piece, is provided in one end section of this connecting shaft, and a second contacting section bent into a U-shape in the opposite direction, which is in contact with the other hinge piece, is provided in the other end section.

When the fallboard is being closed, the first contacting section and the second contacting section come into contact with the respective hinge pieces on both sides and rotate around the connecting shaft. Therefore, the connecting shaft is revolved with the rotation, and a load is applied to the fallboard with the torsion of the connecting shaft.

However, in the configuration of a conventional fallboard opening and closing device, such as this, the connecting shaft of the hinge is gradually rotated when the fallboard is being closed, and the torsion in the connecting shaft is gradually released when the fallboard is being opened. Therefore, there is a problem in that, although the movement of the fallboard can be dampened to slowly close by a load being applied thereto when the fallboard is being closed, the movement of the fallboard can not be dampened to slowly open when the fallboard is being opened because the load applied to the fallboard is merely gradually reduced.

SUMMARY OF THE INVENTION

The present invention has been conceived to solve the above-described problems. An object of the present invention is to provide a fallboard (also known as a key cover) opening and closing device that, when the fallboard is being closed and when the fallboard is being opened, can smoothly and satisfactorily dampen (brake) the rotational movement of the fallboard depending on these opening and closing movements so that the fallboard can be securely opened and closed.

In order to achieve the above-described object, in accordance with one aspect of the present invention, there is provided an opening and closing device for a fallboard rotatably attached to an instrument case provided with a keyboard section, wherein the keyboard section cover is openable and closeable, the opening and closing device, comprising a first damper member for dampening rotational movement of the fallboard by constantly applying a fixed load to the fallboard; and a second damper member for dampening rotational movement of the fallboard by applying a load to the fallboard depending on a closing movement of the fallboard, and for dampening rotational movement of the fallboard by applying a load to the fallboard depending on an opening movement of the fallboard.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENT

The present invention will hereinafter be described in detail with reference to the preferred embodiment shown in FIG. 1 to FIG. 11, where the present invention has been applied to a keyboard instrument.

Figure 1:
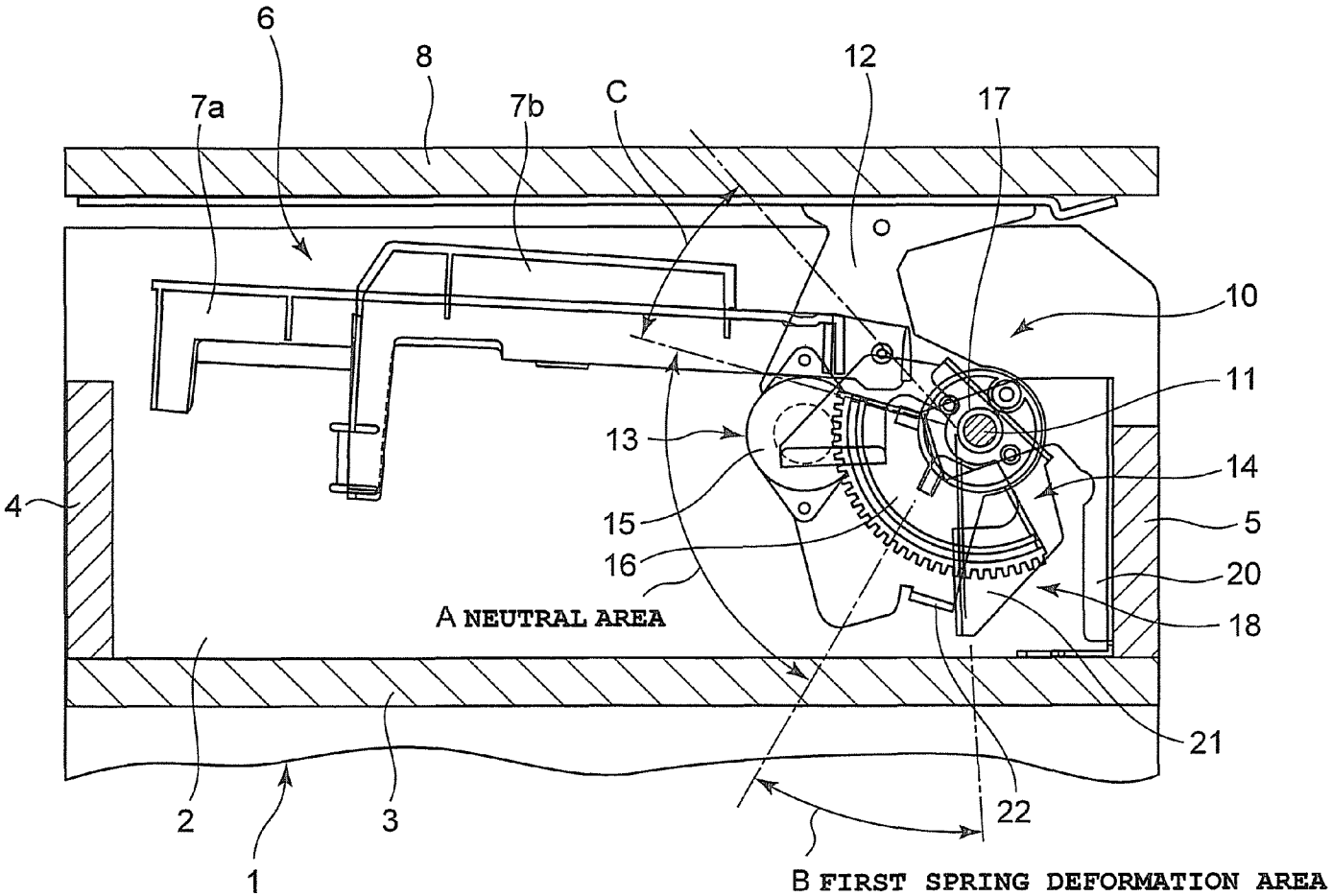
FIG. 1 is a cross-sectional view showing the main section of an embodiment where the present invention has been applied to a keyboard instrument, in which the fallboard has been closed.
Figure 2:
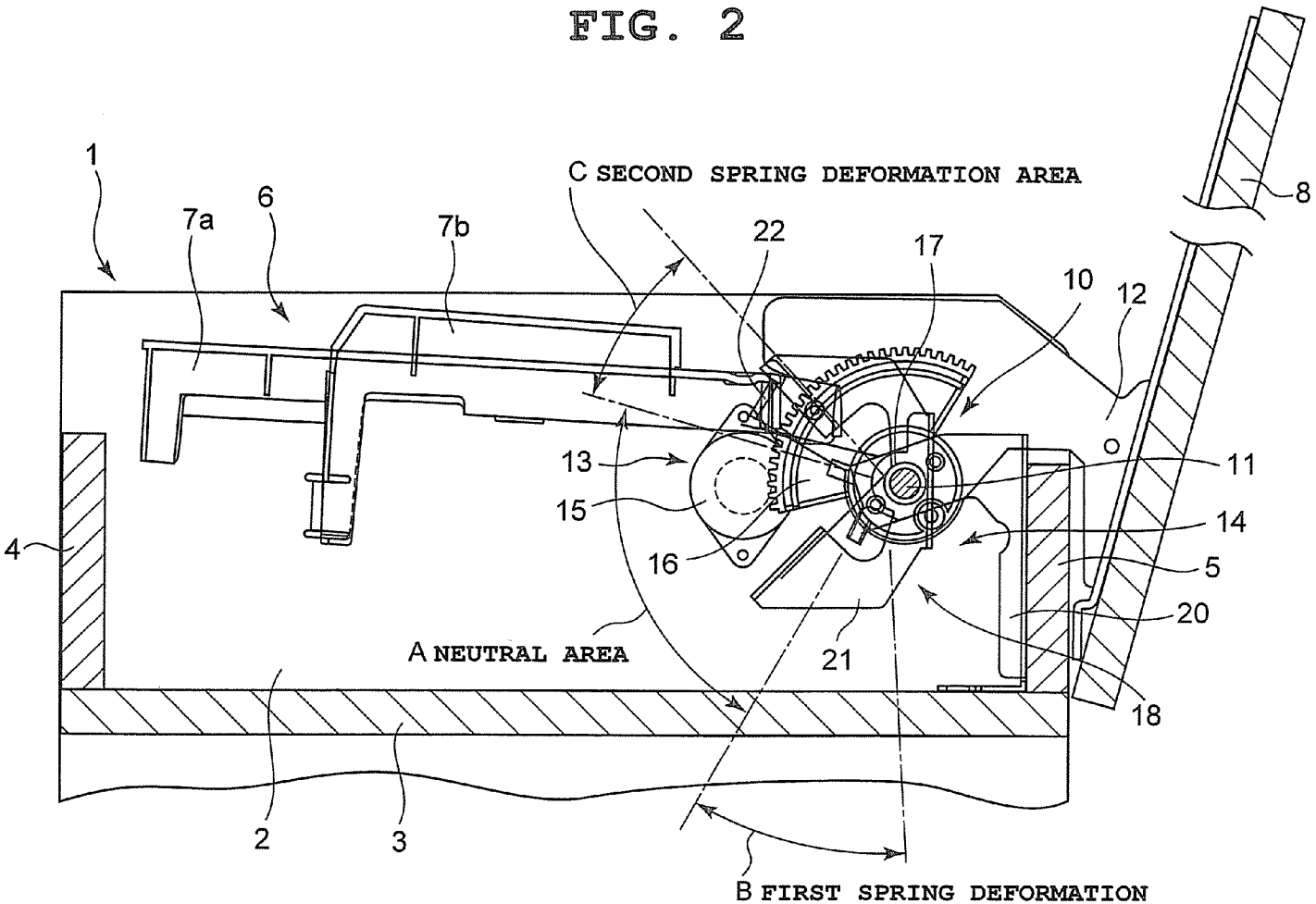
FIG. 2 is a cross-sectional view showing the main section, where the fallboard of the keyboard instrument in FIG. 1 has been opened.

As shown in FIG. 1 and FIG. 2, the keyboard instrument includes an instrument case 1. This instrument case 1 includes a pair of side boards 2 also serving as leg sections, a bottom board 3 provided between the pair of side boards 2 on an upper side, a front board 4 provided on top of the front end section (left end section in FIG. 1) of the bottom board 3, and a rear board 5 provided on top of the rear end section (right end section in FIG. 1) of the bottom board 3.

Also, as shown in FIG. 1 and FIG. 2, a keyboard section 6 is provided inside the instrument case 1. The keyboard section 6, which includes white keys 7*a* and black keys 7*b*, is configured such that numerous white keys 7*a* and black keys 7*b* are aligned with being attached to the top of a keyboard chassis (not shown) in a manner to be rotatable in the vertical direction.

In addition, as shown in FIG. 1 and FIG. 2, a fallboard 8 is provided on the upper section of the instrument case 1 by an opening and closing device 10 that allows it to open and close. This fallboard 8 is rotated in the vertical direction by the opening and closing device 10. When closed, the fallboard 8 covers the keyboard section 6 by being placed over the instrument case 1. When opened, the fallboard 8 stands at a slight tilt towards the rear of the instrument case 1 (right side in FIG. 2) to expose the keyboard section 6.

As shown in FIG. 1 to FIG. 4, the opening and closing device 10 for the fallboard 8 includes a rotation supporting shaft 11 and an arm member 12. The rotation supporting shaft 11 is rotatably provided between the pair of side boards 2 positioned on the rear side inside the instrument case 1, and the arm member 12, which is integrally attached to this rotation supporting shaft 11, is attached to the bottom surface of the fallboard 8. As a result, the fallboard 8 is configured to rotate in the vertical direction with the rotation supporting shaft 11 and the arm member 12, around the rotation supporting shaft 11 to which the arm member 12 is attached.

Also, as shown in FIG. 1 to FIG. 4, the opening and closing device 10 includes a first damper member 13 and a second damper member 14. The first damper member 13 dampens the rotational movement of the fallboard 8 by constantly applying a fixed load thereto. The second damper member 14 dampens the rotational movement of the fallboard 8 by applying a load thereto depending on an opening movement or a closing movement of the fallboard 8.

Figure 3:
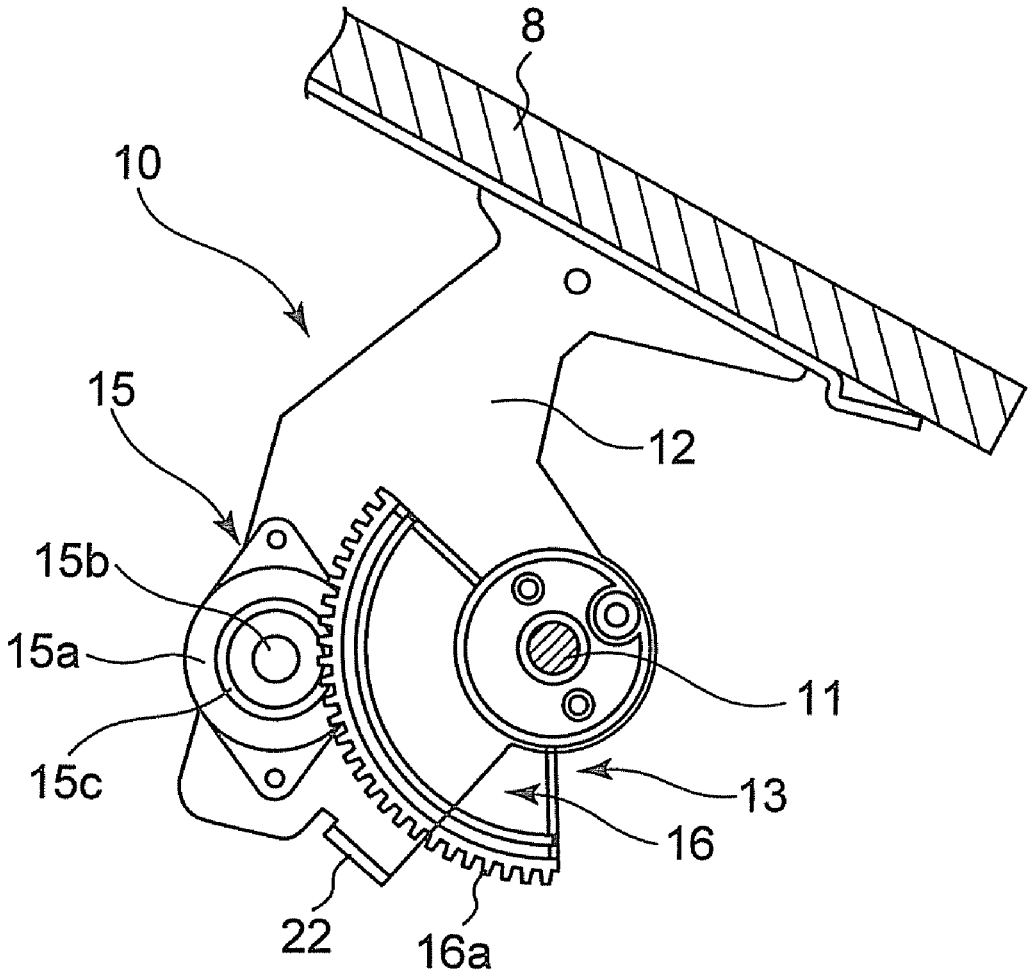
FIG. 3 is an enlarged cross-sectional view of the main section, showing an operating state of a first damper member in the keyboard instrument in FIG. 1 and FIG. 2.

As shown in FIG. 3, the first damper member 13 includes a rotary damper 15 that is used to constantly apply a fixed load to the fallboard 8, and a substantially fan-shaped damper gear 16 that is provided on the rotation supporting shaft 11 and rotates with the fallboard 8. The rotary damper 15 includes a damper body 15*a*, a damper shaft 15*b*, and a pinion 15*c*. The damper body 15*a* is fixed onto an inner surface of the pair of side boards 2. The damper shaft 15*b* is rotatably provided inside the damper body 15*a*, and a fixed load is constantly applied thereto. The pinion 15*c* is a small gear provided on an end section where the damper shaft 15*b* projects from the damper body 15*a*.

Figure 6:
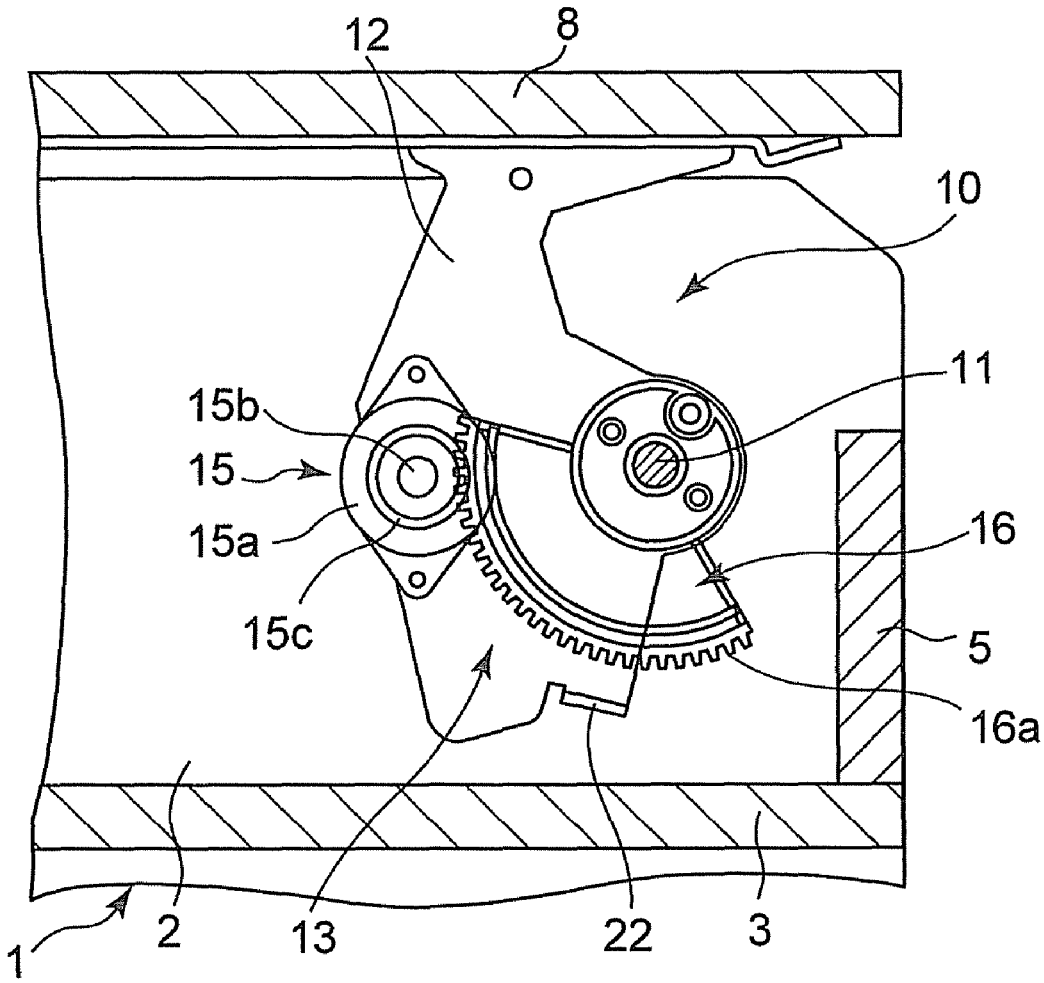
FIG. 6 is an enlarged cross-sectional view of the main section, showing the first damper member in the state shown in FIG. 1.
Figure 10:
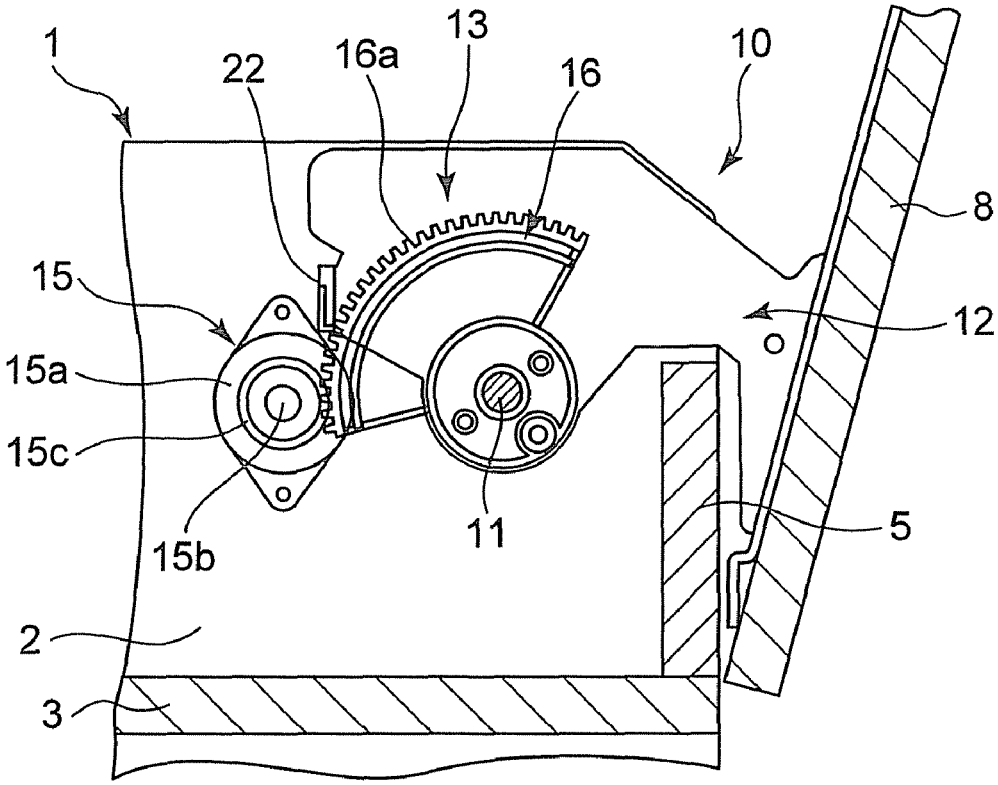
FIG. 10 is an enlarged cross-sectional view of the main section, showing the first damper member in the state shown in FIG. 2.

As shown in FIG. 3, FIG. 6 and FIG. 10, the damper gear 16 is a gear having a sufficiently larger diameter than the pinion 15*c*. The overall damper gear 16 is substantially fan-shaped, and the base portion thereof is provided integrally with the rotation supporting shaft 11. In this state, the damper gear 16 rotates with the fallboard 8 and the arm member 12. A teeth section 16*a* that meshes with the pinion 15*c* of the rotary damper 15 is provided on the outer circumferential edge of the damper gear 16.

Accordingly, in the configuration of the rotary damper 15, as shown in FIG. 3, FIG. 6 and FIG. 10, when an opening or closing operation of the fallboard 8 is performed, the arm member 12 and the rotation supporting shaft 11 rotate with the rotational movement of the fallboard 8. Then, the damper gear 16 rotates with this rotation of the rotation supporting shaft 11, and the pinion 15*c* of the damper shaft 15*b* meshes with the teeth section 16*a* of this damper gear 16 to rotate. At this time, since the fixed load is being applied to the damper shaft 15*b*, a fixed load is applied to the rotational movement of the fallboard 8 and the rotational movement of the fallboard 8 is dampened.

Figure 4:
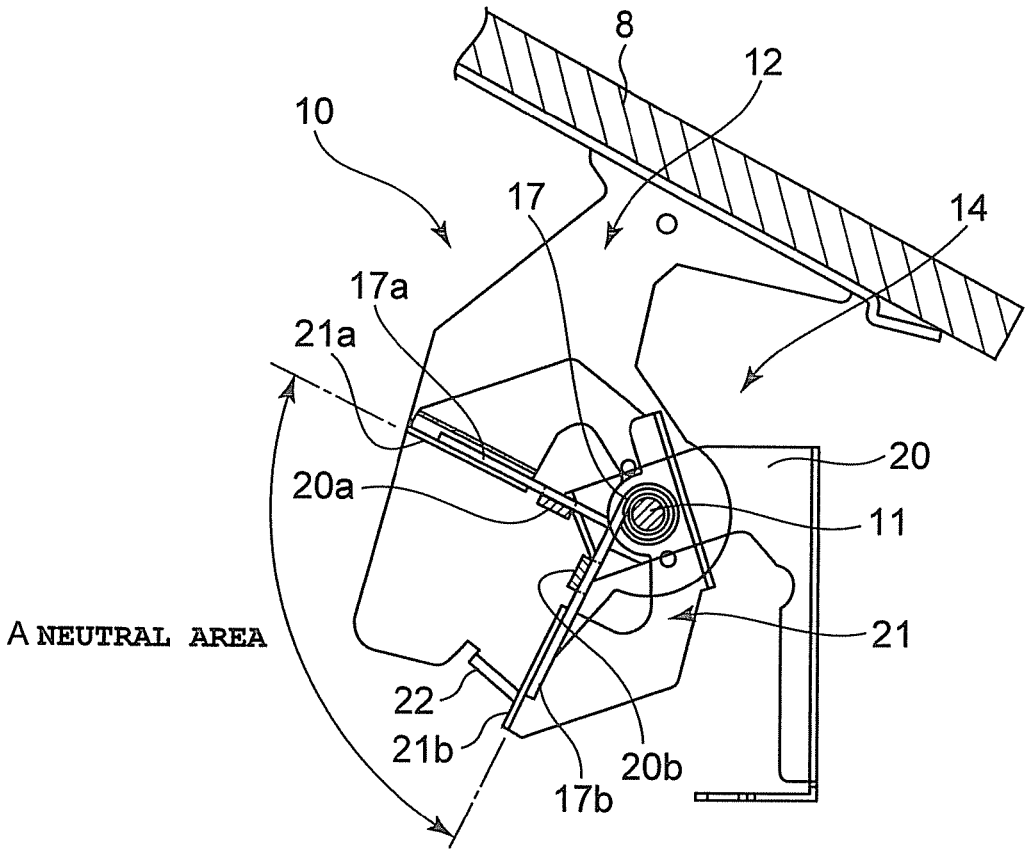
FIG. 4 is an enlarged cross-sectional view of the main section, showing an operating state of a second damper member in the keyboard instrument in FIG. 1 and FIG. 2.
Figure 5:
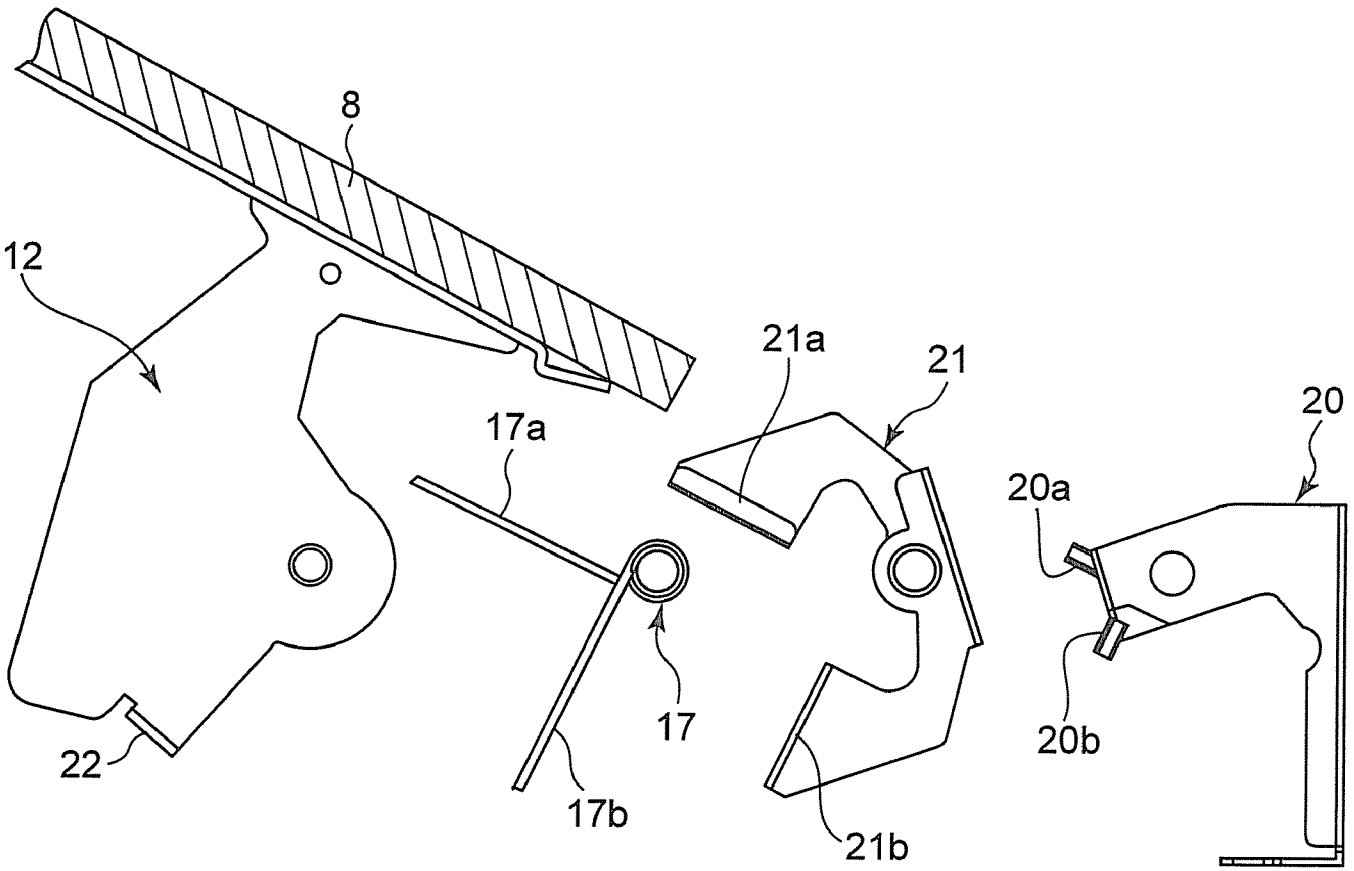
FIG. 5 is an enlarged exploded view of the second damper member in FIG. 4.

On the other hand, as shown in FIG. 4 and FIG. 5, the second damper member 14 includes a torsion coil spring 17 and a spring regulating member 18. The torsion coil spring 17 is a spring member used to apply a load to the fallboard 8. The spring regulating member 18 gradually increases resilient deformation of the torsion coil spring 17 depending on an opening movement or a closing movement of the fallboard 8.

As shown in FIG. 4 and FIG. 5, the torsion coil spring 17 is configured such that a coil-shaped spring body section is attached to the rotation supporting shaft 11, and both end sections 17*a* and 17*b* of the spring body section extend towards the outer periphery of the spring body section with being spread apart at an almost 90 degree angle. Accordingly, the spring body section of the torsion coil spring 17 is configured so as to have flexible torsion and resilient deformation by both end sections 17*a* and 17*b* of the spring body section being flexibly displaceable either in a direction moving away from each other or a direction moving toward each other.

Figure 7:
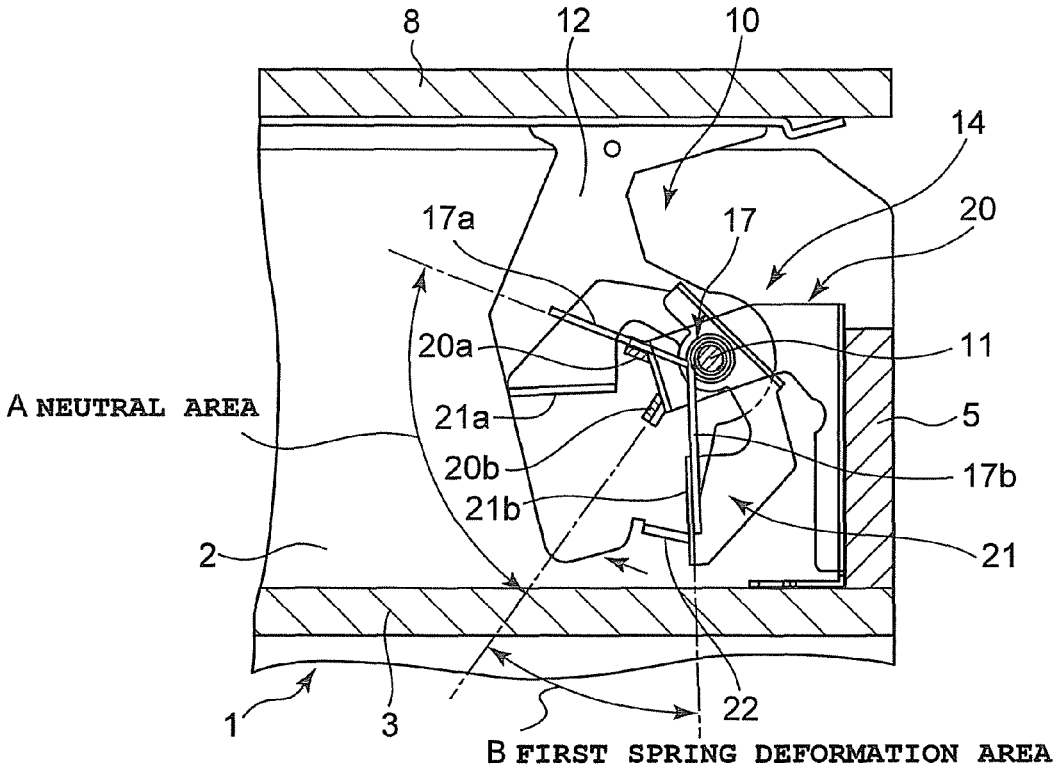
FIG. 7 is an enlarged cross-sectional view of the main section, showing the second damper member in the state shown in FIG. 1.
Figure 8:
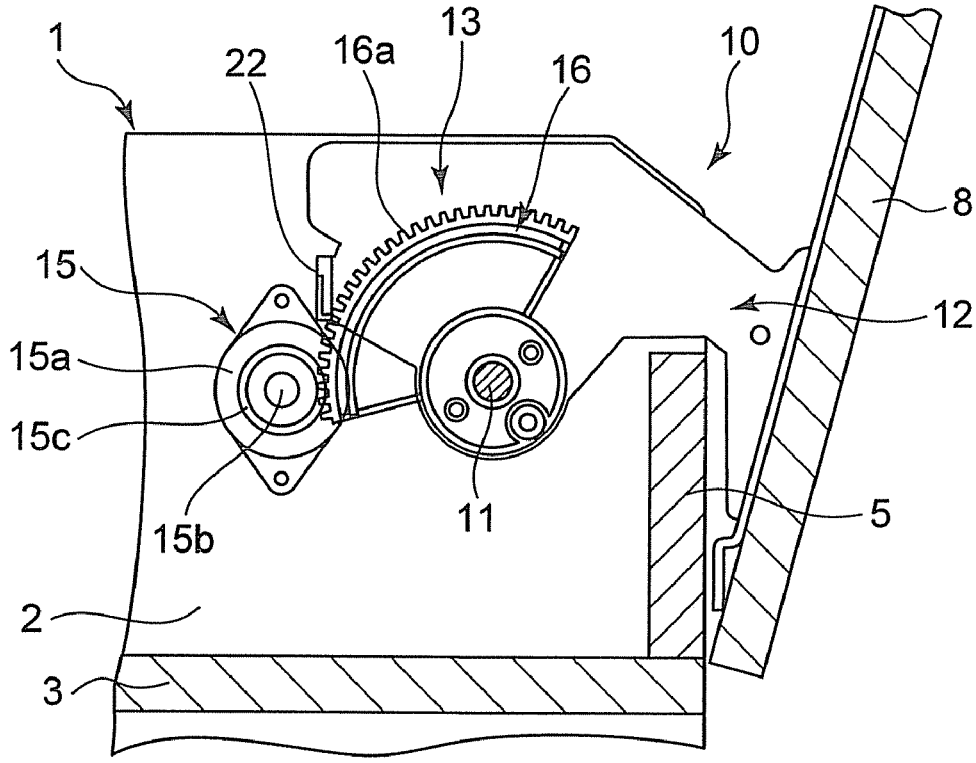
FIG. 8 is an enlarged view of the main section, where the fallboard rotates in an opening direction in a neutral area of the second damper member in FIG. 4.
Figure 9:
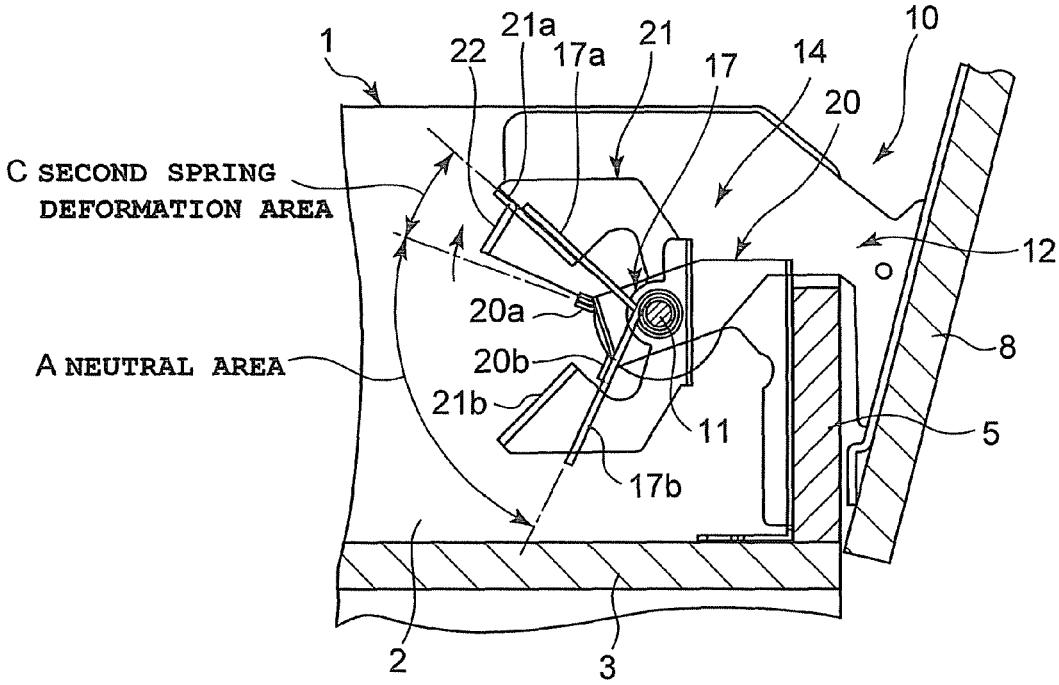
FIG. 9 is an enlarged view of the main section, where the fallboard further rotates in the opening direction, and an arm member and a spring controlling member begin to move in conjunction with each other in the neutral area in FIG. 8.

As shown in FIG. 4, FIG. 8 and FIG. 9, the spring regulating member 18 has a neutral area A where the torsion coil spring 17 returns to an initial state with intermediate states of a position from which the fallboard is completely closed and a position to which the fallboard is completely opened. Also, as shown in FIG. 7, the spring regulating member 18 has a first spring deformation area B where the resilient deformation of the torsion coil spring 17 bordering on the neutral area A is increased depending on a closing movement of the fallboard 8 when being closed.

Figure 11:
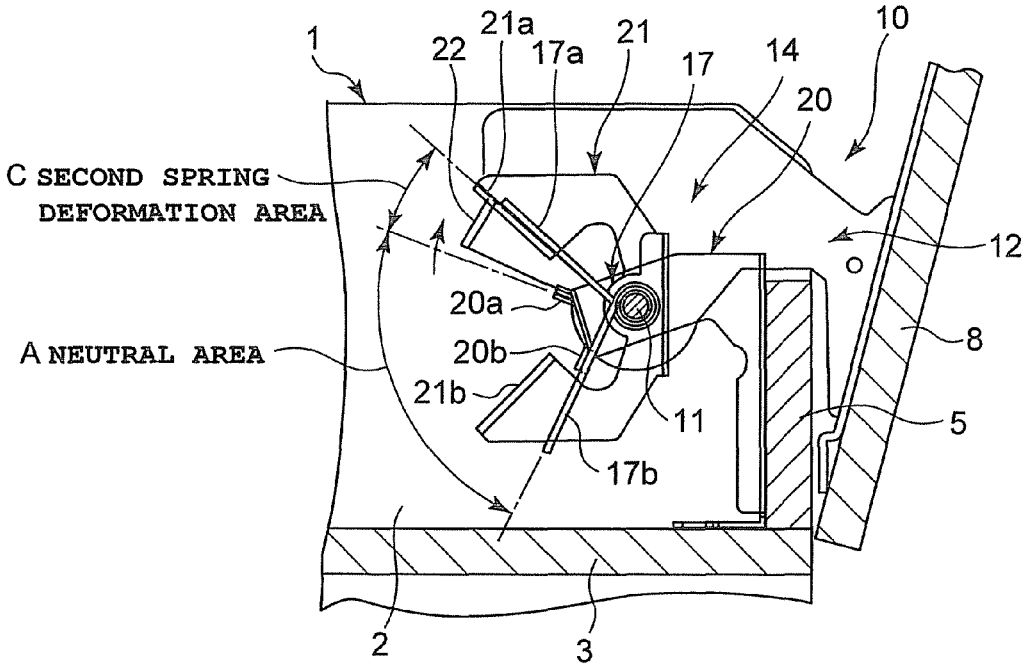
FIG. 11 is an enlarged cross-sectional view of the main section, showing the second damper member in the state shown in FIG. 2.

In addition, as shown in FIG. 11, the spring regulating member 18 has a second spring deformation area C where the resilient deformation of the torsion coil spring 17 bordering on the neutral area A is increased depending on the opening movement of the fallboard 8 when being opened. As a result, the spring regulating member 18 is configured to switch between any one of the neutral area A, the first spring deformation area B, and the second spring deformation area C depending on opening and closing movements of the fallboard 8.

That is, as shown in FIG. 4 and FIG. 5, the spring regulating member 18 includes as components a fixed member 20 provided in the instrument case 1, the rotation supporting shaft 11 which is rotatably held by the fixed member 20 and to which the torsion coil spring 17 is attached, the arm member 12 which is attached to the rotation supporting shaft 11 and on which the fallboard 8 is provided, the spring controlling member 21 which is rotatably attached to the rotation supporting shaft 11 and rotates substantially in conjunction with the arm member 12, and an intermittent interlocking section 22 that intermittently moves the spring controlling member 21 in conjunction with the rotation of the arm member 12.

In this instance, as shown in FIG. 4, FIG. 5 and FIG. 7, the fixed member 20 is fixed on top of the rear section (right side section in FIG. 7) of the bottom board 3 inside the instrument case 1, and the upper section of the fixed member 20 projects towards the front side (left side in FIG. 7) of the instrument case 1. In addition, a first fixed piece 20*a* and a second fixed piece 20*b* are provided in the projecting tip section (left end section in FIG. 5) of the upper section of this fixed member 20.

As shown in FIG. 4 and FIG. 5, the first fixed piece 20*a* is provided in the projecting tip section of the fixed member 20 in a manner to project upwards at an angle of about 45 degrees. One end section 17*a* of the torsion coil spring 17 comes into resilient contact with the first fixed piece 20*a* from a counter-clockwise direction (upper side in FIG. 4), and the first fixed piece 20*a* prevents the one end section 17*a* of the torsion coil spring 17 from being flexibly displaced in the counter-clockwise direction (lower side in FIG. 4).

Also, as shown in FIG. 4 and FIG. 5, the second fixed piece 20*b* is provided in the projecting tip section of the fixed member 20 in a manner to project downwards at an angle of about 45 degrees. The other end section 17*b* of the torsion coil spring 17 comes into resilient contact with the second fixed piece 20*b* from a clockwise direction (obliquely lower right side in FIG. 4), and the second fixed piece 20*b* prevents the other end section 17*b* of the torsion coil spring 17 from being flexibly displaced in the clockwise direction (obliquely upper left side in FIG. 4).

As a result, as shown in FIG. 4 and FIG. 5, the first fixed piece 20*a* and the second fixed piece 20*b* of the fixed member 20 are spread apart at an opening angle of about 90 degrees. The opposite angle (about 270 degrees) of the opening angle is the movable range of both end sections 17*a* and 17*b* of the torsion coil spring 17, and both end sections 17*a* and 17*b* of the torsion coil spring 17 are flexibly displaced within this movable range.

On the other hand, as shown in FIG. 4 and FIG. 5, the overall spring controlling member 21 is formed into a substantial U-shape, and the middle section thereof is rotatably attached to the rotation supporting shaft 11. A first movable piece 21*a* and a second movable piece 21*b* are provided in this spring controlling member 21. As shown in FIG. 4, the first movable piece 21*a*, which is provided on the upper side of the spring controlling member 21, comes into resilient contact with the one end section 17*a* of the torsion coil spring 17 from the clockwise direction (lower left side in FIG. 4) and flexibly displaces the one end section 17*a* of the torsion coil spring 17 in the clockwise direction (diagonally upper right side in FIG. 4) in which the one end section 17*a* is moved away from the first fixed piece 20*a*.

Also, as shown in FIG. 4, the second movable piece 21*b*, which is provided on the lower side of the spring controlling member 21, comes into resilient contact with the other end section 17*b* of the torsion coil spring 17 from the counter-clockwise direction (upper left side in FIG. 4) and flexibly displaces the other end section 17*b* of the torsion coil spring 17 in the counter-clockwise direction (diagonally lower right side in FIG. 4) in which the other end section 17*b* is moved away from the second fixed piece 20*b*. As shown in FIG. 4, the first movable piece 21*a* and the second movable piece 21*b* of the spring controlling member 21 are spread apart at an angle that is almost the same as the opening angle of the first fixed piece 20*a* and the second fixed piece 20*b*, namely at an almost 90 degree angle. In this state, the spring controlling member 21 rotates around the rotation supporting shaft 11 intermittently in conjunction with the arm member 12.

When the spring regulating member 18 is in the neutral area A, as shown in FIG. 4, the first movable piece 21*a* comes into resilient contact with the one end section 17*a* of the torsion coil spring 17, with the one end section 17*a* of the torsion coil spring 17 being in resilient contact with the first fixed piece 20*a* and the position thereof being regulated thereby. In addition, the second movable piece 21*b* comes into resilient contact with the other end section 17*b* of the torsion coil spring 17, with the other end section 17*b* of the torsion coil spring 17 being in resilient contact with the second fixed piece 21*b* and the position thereof being regulated thereby. As a result, the torsion coil spring 17 enters an initial state.

When the spring regulating member 18 is in the first spring deformation area B, as shown in FIG. 7, the second movable piece 21*b* of the spring controlling member 21 flexibly displaces the other end section 17*b* of the torsion coil spring 17 in the direction in which the other end section 17*b* is moved away from the second fixed piece 20*b*, namely in the counter-clockwise direction, with the one end section 17*a* of the torsion coil spring 17 being in resilient contact with the first fixed piece 20*a* of the fixed member 20 and the position thereof being regulated thereby. As a result, the torsion coil spring 17 is resiliently deformed, and by the resilient deformation of the torsion coil spring 17 being increased, the load is applied to the fallboard 8.

When the spring regulating member 18 is in the second spring deformation area C, as shown in FIG. 11, the first movable piece 21*a* of the spring controlling member 21 flexibly displaces the one end section 17*a* of the torsion coil spring 17 in the direction in which the one end section 17*a* is moved away from the first fixed piece 20*a*, namely in the clockwise direction, with the other end section 17*b* of the torsion coil spring 17 being in resilient contact with the second fixed piece 20*b* of the fixed member 20 and the position thereof being regulated thereby. As a result, the torsion coil spring 17 is resiliently deformed, and by the resilient deformation of the torsion coil spring 17 being increased, the load is applied to the fallboard 8.

When the spring regulating member 18 is in the state of being in the neutral area A, the intermittent interlocking section 22, which intermittently moves the arm member 21 in conjunction with the spring controlling member 21, temporarily releases the arm member 12 and the spring controlling member 21 from the interlocked state as shown in FIG. 4, FIG. 8 and FIG. 9, and when the spring regulating member 18 is in the state of being in the first spring deformation area B, interlocks the arm member 12 and the spring controlling member 21 as shown in FIG. 7. The intermittent interlocking section 22 also interlocks the arm member 12 and the spring controlling member 21 when the spring regulating member 18 is in the state of being in the second spring deformation area C, as shown in FIG. 11.

That is, the intermittent interlocking section 22 is a contacting section that is provided in an area of the arm member 12 positioned between the first movable piece 21*a* and the second movable piece 21*b* of the spring controlling member 21, and comes into contact with either the first movable piece 21*a* or the second movable piece 21*b*. As shown in FIG. 4, FIG. 8 and FIG. 9, when the spring regulating member 18 is in the state of being in the neutral area A, this intermittent interlocking section 22 moves between the first movable piece 21*a* and the second movable piece 21*b*, thereby releasing the arm member 12 and the spring controlling member 2 from the interlocked state.

Also, as shown in FIG. 7, when the spring regulating member 18 is in the state of being in the first spring deformation area B, this intermittent interlocking section 22 comes into contact with the second movable piece 21*b* and moves the second movable piece 21*b* in the counter-clockwise direction in which the second movable piece 21*b* is moved away from the second fixed piece 20*b*. When the spring regulating member 18 is in the state of being in the second spring deformation area C, the intermittent interlocking section 22 comes into contact with the first movable piece 21*a* and moves the first movable piece 21*a* in the clockwise direction in which the first movable piece 21*a* is moved away from the first fixed piece 20*a*, as shown in FIG. 11.

Next, the opening and closing of the fallboard 8 of a keyboard instrument such as that described above will be described. First, when the fallboard 8 is being opened from the closed state, as shown in FIG. 2, FIG. 3 and FIG. 10, the first damper member 13 constantly applies a fixed load to the fallboard 8 to dampen (brake) the rotational movement thereof. In addition, as shown in FIG. 2 and FIG. 11, the second damper member 14 applies a load to the fallboard 8 to dampen the rotational movement thereof, depending on the opening movement of the fallboard 8.

That is, as shown in FIG. 2 and FIG. 3, in the first damper member 13, when the fallboard 8 is rotated in the opening direction, the rotation support shaft 11 rotates with the rotational movement of the fallboard 8. Then, the damper gear 16 rotates with this rotation of the rotation supporting shaft 11, and the pinion 15*c* of the rotary damper 15 meshes with the teeth section 16*a* of the damper gear 16 to rotate.

At this time, a fixed load is constantly applied to the damper shaft 15*b* of the rotary damper 15. Therefore, when the pinion 15*c* provided on the damper shaft 15*b* meshes with the teeth section 16*a* of the damper gear 16 to rotate, the fixed load is applied to the pinion 15*c*, the rotation supporting shaft 11, and the fallboard 8, and as a result of this load, the rotational movement of the fallboard 8 is dampened.

As shown in FIG. 1 and FIG. 2, in the second damper member 14, when the fallboard 8 is rotated in the opening direction from the closed state, the spring controlling member 21 rotates in the clockwise direction in conjunction with the arm member 12 because of the intermittent interlocking section 22 being in contact with the second movable piece 21*b* of the spring controlling member 21 by the spring force of the torsion coil spring 17, until the fallboard 8 opens to a predetermined angle (angle of about 15 degrees) shown in FIG. 4 from the closed state shown in FIG. 7, that is, until the spring regulating member 18 reaches the neutral area A from the first spring deformation area B.

At this time, as shown in FIG. 7, the first movable piece 21*a* of the spring controlling member 21 moves towards the direction in which the first movable piece 21*a* approaches the first fixed piece 20*a*, with the one end section 17*a* of the torsion coil spring 17 being in resilient contact with the first fixed piece 20*a* of the fixed member 20 and the position thereof being regulated thereby. In addition, the second movable piece 21*b* moves towards the direction in which the second movable piece 21*b* approaches the second fixed piece 20*b*, with the other end section 17*b* of the torsion coil spring 17 being in resilient contact with the second movable piece 21*b*.

As a result, the other end section 17*b* of the torsion coil spring 17 is flexibly displaced with the second movable piece 21*b* in the direction in which they approach the second fixed piece 20*b*. At this time, the torsion coil spring 17 attempts to flexibly return from the state in the first spring deformation area B to the initial state in the neutral area A, and therefore, the spring force works in the opening direction of the fallboard 8 while gradually decreasing. As a result, the opening of the fallboard 8 can be initiated with a light force.

Then, as shown in FIG. 4, when the other end section 17*b* of the torsion coil spring 17 comes into resilient contact with the second fixed piece 20*b*, the spring regulating member 18 enters the state of being in the neutral area A. At this time, the position of the other end section 17*b* of the torsion coil spring 17 is regulated by the second fixed piece 20*b*, and the second movable piece 21*b* is positioned on an extension of the second fixed piece 20*b* with the second movable piece 21*b* being in resilient contact with the other end section 17*b* of the torsion coil spring 17. In addition, the one end section 17*a* of the torsion coil spring 17 is positioned on an extension of the first fixed piece 20*a* with being in resilient contact with the first fixed piece 20*a* and the position thereof being regulated thereby, in a state where the first movable piece 21*a* is in resilient contact with the one end section 17*a* of the torsion coil spring 17. As a result, the torsion coil spring 17 returns to the initial state. The spring force of the torsion coil spring 17 is not applied to the fallboard 8, and therefore the opening movement of the fallboard 8 is only dampened by the first damper member 13.

As shown in FIG. 8 and FIG. 9, when the spring regulating member 18 is in the state of being in the neutral area A, the spring controlling member 21 does not rotate with the arm member 12 and the state shown in FIG. 4 is maintained, even when the fallboard 8 is rotated in the opening direction. That is, when the spring regulating member 18 is in the state of being in the neutral area A, as shown in FIG. 8, the intermittent interlocking section 22 of the arm member 12 moves away from the second movable piece 21*b* of the spring controlling member 21 toward the first movable piece 21*a*. Accordingly, the intermittent interlocking section 22 of the arm member 21 is in contact with neither the first movable piece 21*a* nor the second movable piece 21*b* of the spring controlling member 21, and therefore the spring controlling member 21 does not rotate, and the arm member 12 rotates with the fallboard 8. At this time, because the spring force of the torsion coil spring 17 is not applied to the fallboard 8, the opening movement of the fallboard 8 is dampened only by the first damper member 13.

Then, when the fallboard 8 is further rotated in the opening direction to a predetermined angle (angle of about 90 degrees) as shown in FIG. 9, the intermittent interlocking section 22 of the arm member 12 comes into contact with the first movable piece 21*a* of the spring controlling member 21, and the spring regulating member 18 enters the state of being in the second spring deformation area C. When the fallboard 8 is further rotated in the opening direction from the angle of about 90 degrees in this state, as shown in FIG. 2 and FIG. 11, the fallboard 8 stands at a tilt toward the rear (right side in FIG. 11), and opens the instrument case 1 to expose the keyboard section 6.

At this time, as shown in FIG. 11, the intermittent interlocking section 22 of the arm member 12 pushes the first movable piece 21*a* of the spring controlling member 21 upward and moves the first movable piece 21*a* in the clockwise direction in which the first movable piece 21*a* is moved away from the first fixed member 20*a*. Then, as shown in FIG. 11, the first movable piece 21*a* flexibly displaces the one end section 17*a* of the torsion coil spring 17 in the clockwise direction in which the one end section 17*a* is moved away from the first fixed piece 20*a*.

As a result, the torsion coil spring 17 is resiliently deformed such that the spring body section is torsioned, and the spring force is applied to the fallboard 8. At this time, the resilient deformation of the torsion coil spring 17 gradually increases as the fallboard 8 is opened. Therefore, the opening movement of the fallboard 8 is dampened by the torsion coil spring 17, and as a result, the opening force of the fallboard 8 gradually becomes heavier, and the opening movement of the fallboard 8 gradually becomes slower. At this time, play in the meshing between the pinion 15*c* and the teeth section 16*a* of the damper gear 16 caused by backlash in the first damper member can be prevented. Accordingly, the fallboard 8 is satisfactorily dampened also by the first damper member 13.

Next, the closing of the fallboard 8 from the opened state will be described. In this instance, as shown in FIG. 2, FIG. 3 and FIG. 6, the first damper member 13 constantly applies a fixed load to the fallboard 8 to dampen the rotational movement thereof. In addition, as shown in FIG. 2 and FIG. 7, the second damper member 14 applies a load to the fallboard 8 to dampen the rotational movement thereof, depending on the closing movement of the fallboard 8.

That is, as shown in FIG. 3, in the first damper member 13, the rotation support shaft 11 also rotates with the rotational movement of the fallboard 8 when the fallboard 8 is rotated in the closing direction. Then, the damper gear 16 rotates with this rotation of the rotation supporting shaft 11, and the pinion 15*c* of the rotary damper 15 meshes with the teeth section 16*a* of the damper gear 16 to rotate.

At this time as well, a fixed load is constantly applied to the damper shaft 15*b* of the rotary damper 15. Therefore, when the pinion 15*c* provided on the damper shaft 15*b* meshes with the teeth section 16*a* of the damper gear 16 to rotate, the fixed load is applied to the pinion 15*c*, the rotation supporting shaft 11, and the fallboard 8, and as a result of this load, the rotational movement of the fallboard 8 is dampened.

As shown in FIG. 11, in the second damper member 14, when the fallboard 8 is rotated in the closing direction from the completely opened state, the spring controlling member 21 rotates in the counter-clockwise direction in conjunction with the arm member 12 because of the intermittent interlocking section 22 being in contact with the first movable piece 21*a* of the spring controlling member 21 by the spring force of the torsion coil spring 17, until the fallboard 8 closes to a predetermined angle (angle of about 90 degrees) shown in FIG. 9 from the opened state, that is, until the spring regulating member 18 reaches the neutral area A from the second spring deformation area C.

At this time, as shown in FIG. 11, the second movable piece 21*b* of the spring controlling member 21 moves towards the direction in which the second movable piece 21*b* approaches the second fixed piece 20*b*, with the other end section 17*b* of the torsion coil spring 17 being in resilient contact with the second fixed piece 20*b* of the fixed member 20 and the position thereof being regulated thereby. In addition, the first movable piece 21*a* moves towards the direction in which the first movable piece 21*a* approaches the first fixed piece 20*a*, with the one end section 17*a* of the torsion coil spring 17 being in resilient contact with the first movable piece 21*a*.

As a result, the one end section 17*a* of the torsion coil spring 17 is flexibly displaced with the first movable piece 21*a* in the direction in which they approach the first fixed piece 20*a*. At this time, the torsion coil spring 17 attempts to flexibly return from the state in the second spring deformation area C to the initial state in the neutral area A, and therefore, the spring force works in the closing direction of the fallboard 8 while gradually decreasing. As a result, the closing of the fallboard 8 can be initiated with a light force.

Then, as shown in FIG. 9, when the one end section 17*a* of the torsion coil spring 17 comes into resilient contact with the first fixed piece 20*a*, the spring regulating member 18 enters the state of being in the neutral area A. At this time, the position of the one end section 17*a* of the torsion coil spring 17 is regulated by the first fixed piece 20*a*, and the first movable piece 21*a* is positioned on an extension of the first fixed piece 20*a* with the first movable piece 21*a* being in resilient contact with the one end section 17*a* of the torsion coil spring 17. In addition, the other end section 17*b* of the torsion coil spring 17 is positioned on an extension of the second fixed piece 20*b* with being in resilient contact with the second fixed piece 20*b* and the position thereof being regulated thereby, in a state where the second movable piece 21*a* is in resilient contact with the other end section 17*b* of the torsion coil spring 17. As a result, the torsion coil spring 17 returns to the initial state. The spring force of the torsion coil spring 17 is not applied to the fallboard 8, and therefore the closing movement of the fallboard 8 is only dampened by the first damper member 13.

As shown in FIG. 8 and FIG. 9, when the spring regulating member 18 is in the state of being in the neutral area A, the spring controlling member 21 does not rotate with the arm member 12 and the state shown in FIG. 9 is maintained in a manner similar to that when the fallboard 8 is being opened, even when the fallboard 8 is rotated in the closing direction. That is, when the spring regulating member 18 is in the state of being in the neutral area A, as shown in FIG. 8, the intermittent interlocking section 22 of the arm member 12 moves away from the first movable piece 21*a* of the spring controlling member 21 toward the second movable piece 21*b*. Accordingly, the intermittent interlocking section 22 of the arm member 21 is in contact with neither the first movable piece 21*a* nor the second movable piece 21*b* of the spring controlling member 21, and therefore the spring controlling member 21 does not rotate, and the arm member 12 rotates with the fallboard 8. At this time, because the spring force of the torsion coil spring 17 is not applied to the fallboard 8, the closing movement of the fallboard 8 is dampened only by the first damper member 13.

Then, when the fallboard 8 is further rotated in the closing direction to a predetermined angle (angle of about 15 degrees) as shown in FIG. 4, the intermittent interlocking section 22 of the arm member 12 comes into contact with the second movable piece 21*b* of the spring controlling member 21, and the spring regulating member 18 enters the state of being in the first spring deformation area B. When the fallboard 8 is further rotated in the closing direction from the angle of about 15 degrees in this state, as shown in FIG. 1 and FIG. 7, the fallboard 8 covers the keyboard section 6 by being placed over the instrument case 1.

At this time, as shown in FIG. 7, the intermittent interlocking section 22 of the arm member 12 pushes the second movable piece 21*b* of the spring controlling member 21 upward and moves the second movable piece 21*b* in the counter-clockwise direction in which the second movable piece 21*b* is moved away from the second fixed member 20*b*. Then, as shown in FIG. 7, the second movable piece 21*b* flexibly displaces the other end section 17*b* of the torsion coil spring 17 in the counter-clockwise direction in which the other end section 17*b* is moved away from the second fixed piece 20*b*.

As a result, the torsion coil spring 17 is resiliently deformed such that the spring body section is torsioned, and the spring force is applied to the fallboard 8. At this time, the resilient deformation of the torsion coil spring 17 gradually increases as the fallboard 8 is closed. Therefore, the closing movement of the fallboard 8 is dampened by the torsion coil spring 17, and as a result, the closing force of the fallboard 8 gradually becomes heavier, and the closing movement of the fallboard 8 gradually becomes slower. At this time as well, play in the meshing between the pinion 15*c* and the teeth section 16*a* of the damper gear 16 caused by backlash in the first damper member 13 can be prevented. Accordingly, the fallboard 8 is satisfactorily dampened also by the first damper member 13.

As described above, the opening and closing device 10 for the fallboard 8 includes the first damper member 13 which constantly applies a fixed load to the fallboard 8 to dampen the rotational movement thereof, and the second damper member 14 which applies a load to the fallboard 8 depending on an opening or a closing movement of the fallboard 8 in order to dampen the rotational movement thereof. Accordingly, when the fallboard 8 is being closed or opened, the rotational movement thereof can be infallibly and satisfactorily dampened depending on this opening or closing movement.

That is, in the opening and closing device 10 for the fallboard 8, when the fallboard 8 is being closed, the first damper member 13 can constantly apply a fixed load to the fallboard 8 to dampen the rotational movement thereof, and the second damper member 14 can apply a load to the fallboard 8 depending on the closing movement of the fallboard 8 in order to dampen the rotational movement thereof. Accordingly, the closing force of the fallboard 8 can be made heavy and the closing movement of the fallboard 8 can be made slow. As a result, the fallboard 8 can be securely closed.

In addition, in the opening and closing device 10 for the fallboard 8, when the fallboard 8 is being opened, the first damper member 13 can constantly apply a fixed load to the fallboard 8 to dampen the rotational movement thereof, and the second damper member 14 can apply a load to the fallboard 8 depending on the opening movement of the fallboard 8 in order to dampen the rotational movement thereof. Accordingly, the opening force of the fallboard 8 can be made heavy and the opening movement of the fallboard 8 can be made slow. As a result, the fallboard 8 can be securely opened. Thus, when the fallboard 8 is being closed and when the fallboard 8 is being opened, the rotational movement thereof can be infallibly and satisfactorily dampened depending on these opening and closing movements so that the fallboard 8 can be securely opened and closed.

In this instance, the second damper member 14 includes the torsion coil spring 17 which is a spring member used to apply a load to the fallboard 8, and the spring regulating member 18 which gradually increases the resilient deformation of the torsion coil spring 17 depending on the closing movement of the fallboard 8 and gradually increases the resilient deformation of the torsion coil spring 17 depending on the opening movement of the fallboard 8. Therefore, when the fallboard 8 is being closed and when the fallboard 8 is being opened, the spring regulating member 18 can increase the load applied to the fallboard 8 by the torsion coil spring 17.

That is, the spring regulating member 18, which has the neutral area A where the torsion coil spring 17 serving as a spring member returns to the initial state, the first spring deformation area B where the resilient deformation of the torsion coil spring 17 is increased with the end of the neutral area A as the starting point depending on the closing movement of the fallboard 8 being closed, and the second spring deformation area C where the resilient deformation of the torsion coil spring 17 is increased with the end of the neutral area A as the starting point depending on the opening movement of the fallboard 8 being opened, moves to any of each area A to C depending on the opening and closing movements of the fallboard 8. Therefore, the torsion coil spring 17 can infallibly apply a load to the fallboard 8 to dampen the rotational movement thereof, depending on the opening and closing movements of the fallboard 8.

That is, when the fallboard 8 is being closed, the location of the spring regulating member 18 switches from the neutral area A to the first spring deformation area B, and the load applied to the fallboard 8 by the torsion coil spring 17 is increased in this first spring deformation area B depending on the resilient deformation of the torsion coil spring 17. Also, when the fallboard 8 is being opened, the location of the spring regulating member 18 switches from the neutral area A to the second spring deformation area C, and the load applied to the fallboard 8 by the torsion coil spring 17 is increased in this second spring deformation area C depending on the resilient deformation of the torsion coil spring 17. Accordingly, a load can be infallibly applied to the fallboard 8 by the location of the spring regulating member 18 being switched to any of each area A to C, and the rotational movement of the fallboard 8 can be dampened thereby, depending on the opening and closing movements of the fallboard 8.

In this instance, the spring regulating member 18 includes the fixed member 20 provided on the instrument case 1, the rotation supporting shaft 11 which is rotatably held by the fixed member 20 and to which the torsion coil spring 17 is attached, the arm member 12 which is integrally attached to the rotation supporting shaft 11 and on which the fallboard 8 is provided, and the spring controlling member 21 which is rotatably attached to the rotation supporting shaft 11 and rotates substantially in conjunction with the arm member 12. Accordingly, the spring force of the torsion coil spring 17 can be infallibly applied to the fallboard 8 when the arm member 12 and the spring controlling member 21 are in the state of being interlocked. As a result, when the fallboard 8 is being opened and closed, the rotational movement thereof can be infallibly and satisfactorily dampened by a load applied to the fallboard 8.

Also, in the configuration of the spring regulating member 18, the fixed member 20 is configured to include the first fixed piece 20*a* which is in resilient contact with the one end section 17*a* of the torsion coil spring 17 in a manner to be separable, and regulates the flexible displacement of the one end section 17*a* towards one side, and the second fixed piece 20*b* which is in resilient contact with the other end section 17*b* of the torsion coil spring 17 in a manner to be separable, and regulates the flexible displacement of the other end section 17*b* towards the other side. Accordingly, the moveable range of both end sections 17*a* and 17*b* of the torsion coil spring 17 can be infallibly regulated by the first fixed piece 20*a* and the second fixed piece 20*b*. As a result, the range of resilient deformation of the torsion coil spring 17 can be accurately regulated.

Furthermore, in the configuration of the spring regulating member 18, the spring controlling member 21 is configured to include the first movable piece 21*a* which flexibly displaces the one end section 17*a* of the torsion coil spring 17 in the direction in which the one end section 17*a* moves away from the first fixed piece 20*a* depending on the opening and closing movements of the fallboard 8, and the second movable piece 21*b* which flexibly displaces the other end section 17*b* of the torsion coil spring 17 in the direction in which the other end section 17*b* moves away from the second fixed piece 20*b* depending on the opening and closing movements of the fallboard 8. Therefore, the torsion coil spring 17 can be resiliently deformed without fail depending on the opening and closing movements of the fallboard 8, and the spring force of the torsion coil spring 17 depending on the resilient deformation can be applied to the fallboard 8 as a load.

In this instance, when in the state of being in the neutral area A, the spring regulating member 18 regulates the position of the one end section 17*a* by placing the one end section 17*a* of the torsion coil spring 17 in resilient contact with the first fixed piece 20*a*, and regulates the position of the other end section 17*b* by placing the other end section 17*b* of the torsion coil spring 17 in resilient contact with the second fixed piece 20*b*, thereby placing the torsion coil spring 17 in the initial state. Accordingly, when the spring regulating member 18 is in the state of being in the neutral area A, the spring force of the torsion coil spring 17 is not applied to the fallboard 8, and consequently the fallboard 8 can be smoothly and satisfactorily opened and closed.

Also, when the spring regulating member 18 is in the state of being in the first spring deformation area B, the second movable piece 21*b* of the spring controlling member 21 flexibly displaces the other end section 17*b* of the torsion coil spring 17 towards the direction in which the other end section 17*b* is moved away from the second fixed piece 20*b* of the fixed member 20, with the one end section 17*a* of the torsion coil spring 17 being in resilient contact with the first fixed piece 20*a* of the fixed member 20 and the position thereof being regulated thereby. As a result, the resilient deformation of the torsion coil spring 17 is increased, and accordingly the load applied to the fallboard 8 by the torsion coil spring 17 is increased as the fallboard 8 closes. Consequently, the rotational movement of the fallboard 8 gradually becomes heavier, and accordingly the closing movement of the fallboard 8 gradually becomes slower, whereby the fallboard 8 can be securely closed.

In addition, when the spring regulating member 18 is in the state of being in the second spring deformation area C, the first movable piece 21*a* of the spring controlling member 21 flexibly displaces the one end section 17*a* of the torsion coil spring 17 towards the direction in which the one end section 17*a* is moved away from the first fixed piece 20*a* of the fixed member 20, with the other end section 17*b* of the torsion coil spring 17 being in resilient contact with the second fixed piece 20*b* of the fixed member 20 and the position thereof being regulated thereby. As a result, the resilient deformation of the torsion coil spring 17 is increased, and accordingly the load applied to the fallboard 8 by the torsion coil spring 17 is increased as the fallboard 8 opens. Consequently, the rotational movement of the fallboard 8 gradually becomes heavier, and accordingly the closing movement of the fallboard 8 gradually becomes slower, whereby the fallboard 8 can be securely opened.

Moreover, the opening and closing device 10 for the fallboard 8 includes the intermittent interlocking section 22. During the opening and closing movements of the fallboard 8, when the spring regulating member 18 is in the state of being in the first spring deformation area B or the second spring deformation area C, the intermittent interlocking section 22 interlocks the arm member 12 and the spring controlling member 21, and when the spring regulating member 18 is in the state of being in the neutral area A, the intermittent interlocking section 22 temporarily releases the arm member 12 and the spring controlling member 21 from the interlocked state. Accordingly, as a result of the intermittent interlocking section 22 being included in the opening and closing device 10, when the spring regulating member 18 is in the state of being in the first spring deformation area B or the second spring deformation area C, a load can be applied to the fallboard 8 by the torsion coil spring 17 being resiliently deformed. In addition, when the spring regulating member 18 is in the state of being in the neutral area A, a load can be stopped from being applied to the fallboard 8 by the resilient deformation of the torsion coil spring 17 being prevented. Consequently, the fallboard 8 can be smoothly opened and closed.

That is, in this opening and closing device 10 for the fallboard 8, when the spring regulating member 18 is in the state of being in the first spring deformation area B, a load is applied to the fallboard 8, whereby the closing movement thereof can be dampened. As a result, the closing movement of the fallboard 8 can be made slower immediately before the fallboard 8 is completely closed. In addition, when the spring regulating member 18 is in the state of being in the second spring deformation area C, a load is applied to the fallboard, whereby the opening movement of the fallboard 8 can be dampened. As a result, the opening movement of the fallboard 8 can be made slower immediately before the fallboard 8 is completely opened. Moreover, when the fallboard 8 is in an intermediate state between a state in which it is completely closed and a state in which it is completely opened, a load is not applied thereto. Accordingly, the fallboard 8 can be smoothly and satisfactorily opened and closed.

Furthermore, in this opening and closing device 10 for the fallboard 8, the first damper 13 includes the rotary damper 15 which constantly applies a fixed load to the fallboard 8. As a result, a fixed load can be constantly applied to the fallboard 8 by the rotary damper 15, and the rotational movement of the fallboard 8 is constantly dampened thereby. That is, the rotary damper 15 includes the pinion 15*c* provided on the damper shaft 15*c* of the damper body 15*a*, and when this pinion 15*c* rotates after meshing with the teeth section 16*a* of the fan-shaped damper gear 16 integrally attached to the rotation supporting shaft 11 that rotates with the fallboard 8, a fixed load is applied to the damper shaft 15*b*, and the rotational movement of the fallboard 8 is dampened thereby. Accordingly, the rotational movement of the fallboard 8 can be constantly dampened by a fixed load being constantly applied to the fallboard 8.

In the above-described embodiment, a configuration is described in which, in the second damper member 14, the spring controlling member 21 is intermittently interlocked with the arm member 12 by the intermittent interlocking section 22 provided in the arm member 12. However, the intermittent interlocking section 22 is not required to be provided in the arm member 12. A configuration may be used in which the spring controlling member 21 is integrally provided in the arm member 12, and the spring controlling member 21 is constantly interlocked with the arm member 12. In a configuration such as this, when the spring regulating member 18 is in the neutral area A, there is no possibility that only the arm member 12 rotates with the fallboard 8 while the spring controlling member 21 is stopped. In this configuration, the spring controlling member 21 can constantly rotate with the fallboard 8, by which the spring force of the torsion coil spring 17 is applied to the fallboard 8.

Also, in the above-described embodiment, a configuration is described in which both end sections 17*a* and 17*b* of the torsion coil spring 17 are flexibly displaced within the range of an angle of about 270 degrees by the first fixed piece 20*a* and the second fixed piece 20*b* of the fixed member 20. However, the present invention is not limited thereto. For example, a configuration may be used in which both end sections 17*a* and 17*b* of the torsion coil spring 17 are flexibly displaced within the range of an angle of about 90 degrees that is the opening angle of the first fixed piece 20*a* and the second fixed piece 20*b* of the fixed member 20.

In this case, the configuration may be such that, the first fixed piece 20*a* prevents the one end section 17*a* of the torsion coil spring 17 from being flexibly displaced in the clockwise direction, the second fixed piece 20*b* prevents the other end section 17*b* of the torsion coil spring 17 from being flexibly displaced in the counter-clockwise direction, the first movable piece 21*a* flexibly displaces the one end section 17*a* of the torsion coil spring 17 in the counter-clockwise direction, and the second movable piece 21*b* flexibly displaces the other end section 17*b* of the torsion coil spring 17 in the clockwise direction. By this configuration, effects similar to those achieved by the above-described embodiment can be achieved.

Moreover, in the above-described embodiment, a configuration is described in which the first damper member 13 includes the rotary damper 15 where the pinion 15*c* is provided on the damper shaft 15*b*, and the fan-shaped damper gear 16 integrally attached to the rotation supporting shaft 11 that rotates with the fallboard 8. In this configuration, when the pinion 15*c* of the rotary damper 15 rotates after meshing with the teeth section 16*a* of the damper gear 16, the rotational movement of the fallboard 8 is dampened by the load applied to the damper shaft 15*b*. However, the present invention is not limited thereto. A configuration may be used in which the rotary damper 15 directly applies a load to the rotation supporting shaft 11 to dampen the rotational movement of the fallboard 8.

Furthermore, in the above-described embodiment, a case where the torsion coil spring 17 is used as the spring member of the second damper member 14 is described. However, the spring member is not required to be the torsion coil spring 17. For example, a torsion spring may be used.

While the present invention has been described with reference to the preferred embodiments, it is intended that the invention be not limited by any of the details of the description therein but includes all the embodiments which fall within the scope of the appended claims.

What is claimed is:

1. An opening and closing device for a fallboard rotatably attached to an instrument case provided with a keyboard section, wherein a cover of the keyboard section is openable and closeable, the opening and closing device comprising:

a first damper member for dampening rotational movement of the fallboard by constantly applying a fixed load to the fallboard, and a second damper member for dampening rotational movement of the fallboard by applying a load to the fallboard depending on a closing movement of the fallboard, and for dampening rotational movement of the fallboard by applying a load to the fallboard depending on an opening movement of the fallboard, wherein the second damper member comprises a spring member for applying a load to the fallboard, and a spring regulating member for gradually increasing resilient deformation of the spring member depending on a closing movement of the fallboard and for gradually increasing resilient deformation of the spring member depending on an opening movement of the fallboard, wherein the spring regulating member comprises: (i) a neutral area where the spring member returns to an initial state with intermediate states of a position from which the fallboard is completely closed and a position to which the fallboard is completely opened, (ii) a first spring deformation area where resilient deformation of the spring member bordering on the neutral area is increased depending on a closing movement of the fallboard, when closing the fallboard, and (iii) a second spring deformation area where resilient deformation of the spring member bordering on the neutral area is increased depending on an opening movement of the fallboard, when opening the fallboard, which are switched to any one of the neutral area, the first spring deformation area or the second spring deformation area depending on an opening movement or a closing movement of the fallboard, wherein the spring member is a torsion coil spring, wherein the spring regulating member comprises a fixed member provided in the instrument case, a rotation supporting shaft rotatably provided on the fixed member and attached to the torsion coil spring, an arm member integrally attached to the rotation supporting shaft and provided on the fallboard, and a spring controlling member rotatably attached to the rotation supporting shaft and rotates in conjunction with the arm member, wherein the fixed member comprises a first fixed piece separably in contact with an end section of the torsion coil spring and regulates resilient displacement to one side of the end section, and a second fixed piece separably in contact with an other end section of the torsion coil spring and regulates resilient displacement to an other side of the other end section, and wherein the spring controlling member comprises a first movable piece which resiliently displaces the end section of the torsion coil spring towards a direction that separates from the first fixed piece depending on an opening movement or a closing movement of the fallboard, and a second movable piece which resiliently displaces the other end section of the torsion coil spring towards a direction that separates from the second fixed piece depending on an opening movement or a closing movement of the fallboard.

2. The opening and closing device for a fallboard according to claim 1, wherein the spring regulating member: (i) if in a state of the neutral area, regulates positioning by placing the end section of the torsion coil spring in contact with the first fixed piece and regulates positioning by placing the other end section of the torsion coil spring in contact with the second fixed piece, whereby the torsion coil spring is set in the initial state; (ii) if in a state of the first spring deformation area, resilient deformation of the torsion coil spring is increased which regulates positioning by placing the end section of the torsion coil spring in contact with the first fixed piece and performs resilient displacement with the second movable piece of the other end section of the torsion coil spring towards a direction that separates from the second fixed piece, and (iii) if in a state of the second deformation area, resilient deformation of the torsion coil spring is increased which regulates positioning by placing the other end section of the torsion coil spring in contact with the second fixed piece and performs resilient displacement with the first movable piece of the end section of the torsion coil spring towards a direction that separates from the first fixed piece.

3. The opening and closing device for a fallboard according to claim 1, further comprising an intermittent interlocking section for interlocking the arm member and the spring controlling member when the spring regulating member is placed in each state of the first spring deformation area and the second spring deformation area at a time of an opening movement or a closing movement of the fallboard, and interlocking of the arm member and the spring controlling member is released in response to the spring regulating member being placed in a state of the neutral area.

* * * * *